US010218097B2

(12) United States Patent
Phillips et al.

(10) Patent No.: US 10,218,097 B2
(45) Date of Patent: Feb. 26, 2019

(54) CARD EDGE CONNECTOR ASSEMBLY

(71) Applicant: TE CONNECTIVITY CORPORATION, Berwyn, PA (US)

(72) Inventors: Michael John Phillips, Camp Hill, PA (US); Randall Robert Henry, Harrisburg, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 6 days.

(21) Appl. No.: 15/646,644

(22) Filed: Jul. 11, 2017

(65) Prior Publication Data

US 2019/0020132 A1 Jan. 17, 2019

(51) Int. Cl.

| | |
|---|---|
| ***H01R 12/00*** | (2006.01) |
| ***H01R 12/70*** | (2011.01) |
| ***H01R 12/72*** | (2011.01) |
| ***H01R 12/73*** | (2011.01) |
| ***H01R 13/627*** | (2006.01) |

(52) U.S. Cl.

CPC ..... *H01R 12/7023* (2013.01); *H01R 12/707* (2013.01); *H01R 12/721* (2013.01); *H01R 12/73* (2013.01); *H01R 13/6273* (2013.01); *H01R 12/7047* (2013.01); *H01R 12/737* (2013.01)

(58) Field of Classification Search

CPC ..... H01R 12/737; H01R 12/7047; H01R 13/6273; H01R 12/73; H01R 12/721; H01R 12/707; H01R 12/7023

USPC ..... 439/64, 377, 157, 372

See application file for complete search history.

(56) References Cited

U.S. PATENT DOCUMENTS 5,033,972 A * 7/1991 Komatsu ..... G06K 7/0047 439/153
5,511,985 A * 4/1996 Noschese ..... H01R 12/716 439/157
5,542,854 A * 8/1996 Bowen ..... H01R 12/7005 439/157
5,676,555 A * 10/1997 Yu ..... H05K 7/1409 439/157
5,746,613 A * 5/1998 Cheng ..... H05K 7/1409 439/157
5,928,024 A * 7/1999 Ming-Huang ..... H05K 7/1452 361/679.58
6,039,595 A * 3/2000 Tseng ..... H01R 12/7011 439/157
6,077,088 A * 6/2000 Yu ..... H05K 5/0286 439/64
6,152,772 A * 11/2000 Hara ..... H01R 23/6873 439/607.01

(Continued)

*Primary Examiner* — Abdullah Riyami
*Assistant Examiner* — Nelson R Burgos-Guntin

(57) ABSTRACT

A card edge connector assembly includes a card edge connector having a housing defining a card slot receiving a circuit card and a card guide module coupled to the housing. The card guide module has a base and a support beam extending from the base having a support surface supporting the circuit card. The card guide module has a locking arm pivotably coupled to the support beam. The locking arm has a latch at a distal end thereof latchably secured to the circuit card in a latched position to secure the circuit card in the card slot. The locking arm has an ejector engaging the circuit card and moving the circuit card in an unmating direction when the locking arm is moved to an unlatched position.

20 Claims, 3 Drawing Sheets

(56) References Cited

U.S. PATENT DOCUMENTS

| | | | | |
|---|---|---|---|---|
| 6,174,197 | B1 * | 1/2001 | Hirata | H01R 23/70 439/541.5 |
| 6,275,389 | B1 * | 8/2001 | Huang | H05K 7/1431 361/801 |
| 6,296,511 | B1 * | 10/2001 | Tseng | H01R 12/7029 439/377 |
| 6,312,262 | B1 * | 11/2001 | Chiu | H05K 7/1431 439/64 |
| 6,319,017 | B1 * | 11/2001 | Kuo | H01R 13/633 439/377 |
| 6,663,398 | B2 * | 12/2003 | Shimada | H01R 13/6485 439/64 |
| 6,736,671 | B2 * | 5/2004 | Lee | H01R 12/716 439/541.5 |
| 7,063,539 | B2 * | 6/2006 | Ho | H01R 12/721 439/541.5 |
| 7,080,991 | B2 * | 7/2006 | Wang | H01R 12/712 439/79 |
| 7,927,116 | B2 * | 4/2011 | Kestur Nagarajan | G06K 13/0806 439/159 |
| 2007/0190817 | A1 * | 8/2007 | Masubuchi | H01R 13/6485 439/64 |

* cited by examiner

CARD EDGE CONNECTOR ASSEMBLY

BACKGROUND OF THE INVENTION

The subject matter herein relates generally to card edge connector assemblies.

Card edge connectors are used in various system applications. For example, card edge connectors are typically mounted to a host circuit board. The card edge connectors include card slots for receiving a card edge of a circuit card. The circuit card includes electrical components thereon, such as memory, processors and the like forming electrical circuits and interacting with the host circuit board. The card edge connectors are designed for supporting the stand-alone pluggable modules.

However, known card edge connectors are not without disadvantages. For instance, guidance of mating the circuit cards with the card edge connectors may be difficult. For example, the guidance may be performed by a guide module remote from the card edge connector. The guide module may have a dimensional relationship with a chassis or other structure that holds the host circuit board and the dimensional relationship may accumulate several tolerances in the stack-up of the components, leading to misalignment or the need for large gatherability, leading to larger components mounted on the host circuit board. Additionally, the card edge connectors may be subjected to stresses and strains during mating or when mated with the circuit card, which may damage or break the soldered connections between the contacts of the card edge connector and the host circuit board.

A need remains for a card edge connector assembly that may be mated with circuit cards in a reliable manner.

BRIEF DESCRIPTION OF THE INVENTION

In one embodiment, a card edge connector assembly is provided including a card edge connector having a housing defining a card slot configured to receive a circuit card in a mating direction. The housing holds contacts in the card slot to electrically connect to the circuit card that are configured to be electrically connected to a host circuit board. A card guide module is coupled to the housing. The card guide module has a base configured to be secured to the host circuit board and a support beam extending from the base having a support surface configured to support the circuit card. The card guide module has a locking arm pivotably coupled to the support beam and movable between a latched position and an unlatched position. The locking arm has a latch at a distal end thereof configured to be latchably secured to the circuit card in the latched position to secure the circuit card in the card slot. The locking arm has an ejector configured to engage the circuit card and move the circuit card in an unmating direction when the locking arm is moved to the unlatched position.

In another embodiment, a card edge connector assembly is provided including a card edge connector having a housing defining a card slot configured to receive a circuit card in a mating direction. The housing holds contacts in the card slot to electrically connect to the circuit card that are configured to be electrically connected to a host circuit board. The housing has a first end, a second end, a first side and a second side and the contacts are arranged in an array along the first and second sides. A card guide module is coupled to the housing. The card guide module has a base configured to be secured to the host circuit board and a support beam extending from the base having a rail including a first support surface and a second support surface on opposite sides of a channel configured to receive the circuit card. The support beam has a first locating arm at the first support surface being spring biased against a first side of the circuit card and the support beam has a second locating arm at the second support surface being spring biased against a second side of the circuit card to locate the circuit card between the first and second locating arms.

In a further embodiment, a card edge connector assembly is provided including a circuit card having a card edge extending between a first end and a second end having contact pads at a first side and a second side of the circuit card. The card edge connector assembly includes a card edge connector having a housing defining a card slot configured to receive the card edge of the circuit card in a mating direction and holding contacts in the card slot to electrically connect to the contact pads of the circuit card. The card edge connector assembly includes a card guide module coupled to the housing. The card guide module has a base configured to be secured to the host circuit board and a support beam extending from the base having a rail including a channel between first and second support surfaces configured to receive the circuit card. The first and second support surfaces engage the circuit card to hold an X-position of the circuit card relative to the card guide module. The card guide module has locating surfaces engaging the circuit card to hold a Y-position of the circuit card relative to the card guide module. The card guide module has a locking arm engaging the circuit card to hold a Z-position of the circuit card relative to the card guide module. The locking arm has a latch at a distal end thereof configured to be latchably secured to the circuit card to secure the circuit card in the card slot. The card guide module supports the circuit card independent of the card edge connector.

DETAILED DESCRIPTION OF THE INVENTION

Figure 1:
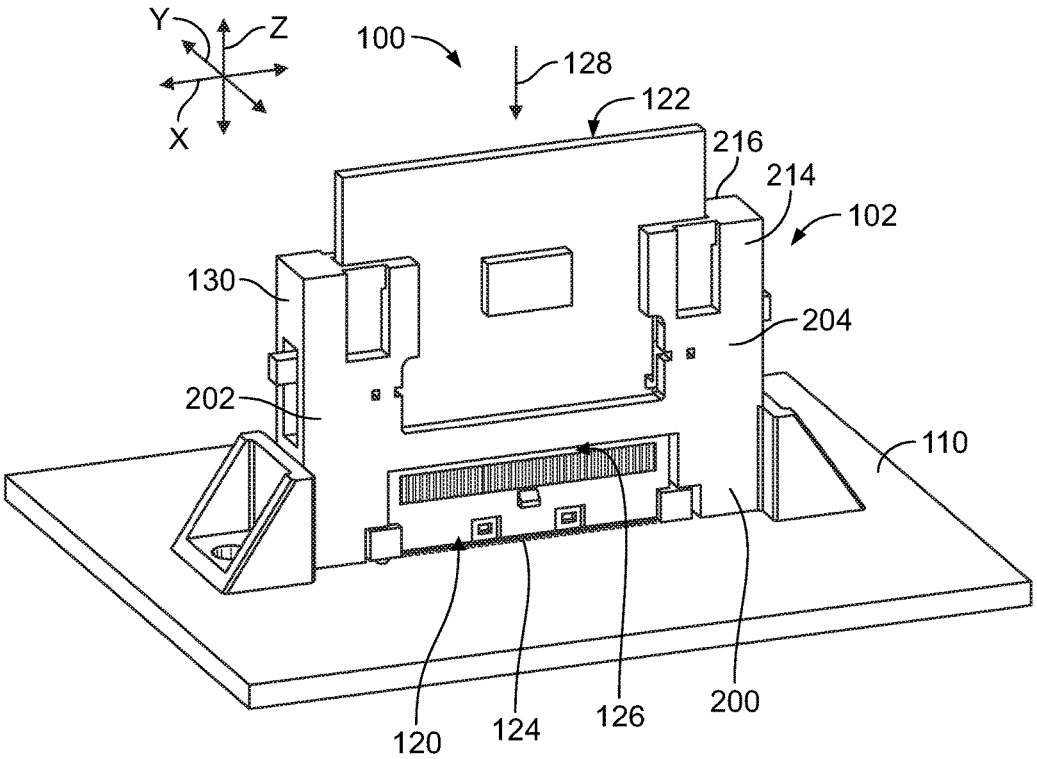
FIG. 1 is a perspective view of an electrical system having a card edge connector assembly in accordance with an exemplary embodiment.
Figure 2:
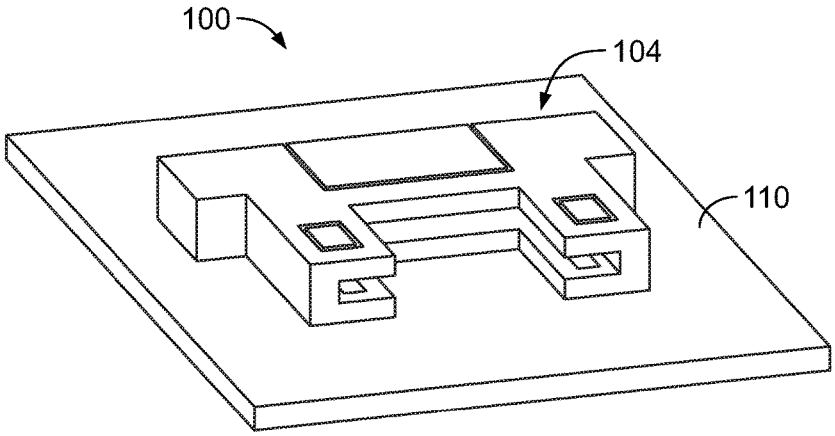
FIG. 2 is a perspective view of the electrical system having a card edge connector assembly in accordance with an exemplary embodiment.

FIG. 1 is a perspective view of an electrical system 100 having a card edge connector assembly 102 in accordance with an exemplary embodiment showing the card edge connector assembly 102 in a mated position. The card edge connector assembly 102 is mounted to a host circuit board 110. In the illustrated embodiment, the card edge connector assembly is a vertical card edge connector assembly where the components are oriented and mated generally vertically or perpendicular to the host circuit board 110. However, in other various embodiments, the electrical system 100 may have components in different orientations, such as at a right angle orientation. For example, FIG. 2 illustrates a right-angle or horizontal card edge connector assembly 104. Other types of card edge connector assemblies may be utilized in alternative embodiments.

The card edge connector assembly 102 includes a card edge connector 120 and a card guide module 130 mounted over the card edge connector 120. The card edge connector assembly 102 includes a circuit card 122 mated with the card edge connector 120 and the card guide module 130. The card edge connector 120 is configured to be mounted to the host circuit board 110, such as by soldering contacts 124 of the card edge connector 120 to the host circuit board 110. The card edge connector 120 has a mating end 126 configured to receive a mating end or card edge of the circuit card 122. In the illustrated embodiment, the mating end 126 is provided at a top of the card edge connector 120 to receive the circuit card 122 in a generally vertical mating direction 128, such as a mating direction perpendicular to the host circuit board 110.

In various embodiments, the card guide module 130 includes a base 200 mounted to the host circuit board 110 independent of the card edge connector 120 such that the card guide module 130 is self-supporting or otherwise not supported by the card edge connector 120. In an exemplary embodiment, the card guide module 130 includes support members for the circuit card 122, such as first and second support beams 202, 204 at opposite ends of the card edge connector 120 to provide guidance and support for the circuit card 122. The support beams 202, 204 may be referred to as vertical support beams because the support beams 202, 204 extend generally vertically. The card guide module 130 alleviates stress or strain on the card edge connector 120 from the circuit card 122, such as from movement of the circuit card 122. The support beams 202, 204 transfer stresses or strains from the circuit card 122 into the base 200 and thus into the host circuit board 110 separate from the card edge connector 120 to alleviate stress or strain on the card edge connector 120.

In an exemplary embodiment, the base 200 of the card guide module 130 surrounds the card edge connector 120, such as above the card edge connector 120, at both ends of the card edge connector 120 and/or at both sides of the card edge connector 120. In the illustrated embodiment, the base 200 connects the support beams 202, 204 such that the card guide module 130 is a single, unitary structure. However, in alternative embodiments, the card guide module 130 may include two separate structures at opposite ends of the card edge connector 120 that are independently mounted to the host circuit board 110. The card guide module 130 extends longitudinally, laterally and transversely, such as along an X axis, a Y axis and a Z axis. For example, the card guide module 130 extends between opposite ends along the X-axis, between opposite sides along the Y-axis and between a top and a bottom along the Z-axis; however, other orientations are possible in alternative embodiments.

FIG. 2 is a perspective view of the electrical system 100 having a card edge connector assembly 104 in accordance with an exemplary embodiment. The card edge connector assembly 104 is similar to the card edge connector assembly 102 (shown in FIG. 1); however, the card edge connector assembly 104 is a horizontal, or right angle card edge connector assembly configured to hold the circuit card 122 (shown in FIG. 1) parallel to the host circuit board 110. The card edge connector assembly 104 includes similar components and features as the card edge connector assembly 102.

Figure 3:
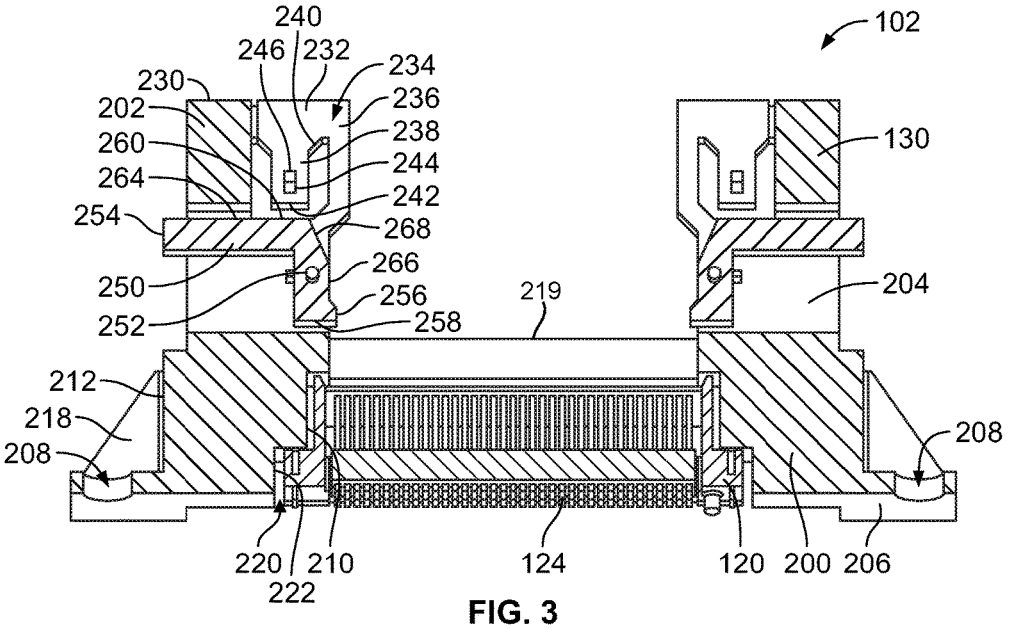
FIG. 3 is a cross sectional view of the card edge connector assembly in accordance with an exemplary embodiment showing a card edge connector and a card guide module.
Figure 4:
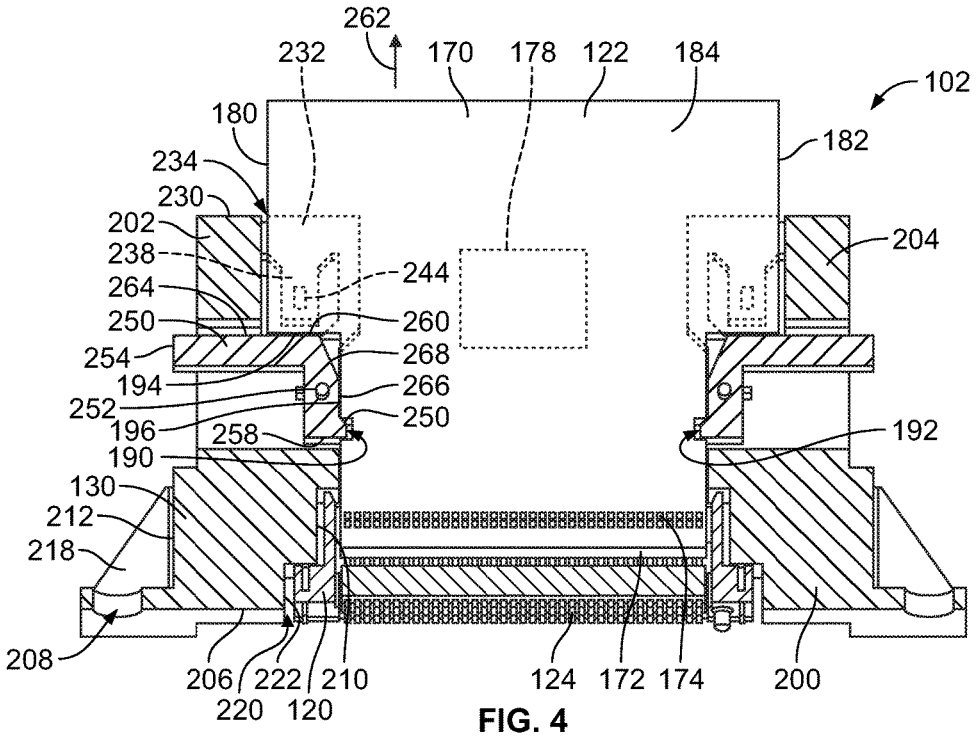
FIG. 4 is a cross sectional view of the card edge connector assembly in accordance with an exemplary embodiment showing a circuit card received in the card guide module and mated with the card edge connector.

FIG. 3 is a cross sectional view of the card edge connector assembly 102 in accordance with an exemplary embodiment showing the card edge connector 120 and the card guide module 130. FIG. 4 is a cross sectional view of the card edge connector assembly 102 in accordance with an exemplary embodiment showing the circuit card 122 received in the card guide module 130 and mated with the card edge connector 120.

With reference to FIG. 4, the circuit card 122 includes a substrate 170 having a card edge 172 at a mating end configured to be loaded into the card guide module 130 and mated with the card edge connector 120. The circuit card 122 has a plurality of contact pads 174 at the card edge 172 configured to be electrically connected to the card edge connector 120. The circuit card 122 includes one or more electrical components 178 mounted to the circuit card 122. For example, the electrical components 178 may include a memory, a processor, or other types of electrical components. The electrical components 178 are electrically connected to corresponding contact pads 174. The circuit card 122 includes various circuits transmitting data and/or power between the contact pads 174 and the electrical components 178. In other various embodiments, the circuit card 122 may include a pluggable body, such as a housing, surrounding the circuit card 122 and/or the electrical components 178. The pluggable body may include one or more heat sinks for dissipating heat from the electrical components 178.

The circuit card 122 extends between a first end 180 and a second end 182. The circuit card 122 has sides 184 between the first and second ends 180, 182. The electrical components 178 may be mounted to the sides 184. The circuit card 122 includes latching feature 190, 192 at the first and second ends 180, 182 for securing the circuit card 122 in the card edge connector assembly 102. In the illustrated embodiment, the latching features 190, 192 are pockets formed in the first and second ends 180, 182. Other types of latching features may be provided in alternative embodiments, such as deflectable latches, clips and the like.

Optionally, the circuit card 122 may include shoulders 194 remote from the card edge 172. The shoulders 194 may define stop surfaces for loading the circuit card 122 into the card edge connector assembly 102. In the illustrated embodiment, the shoulders 194 are provided adjacent the first and second ends 180, 182.

Optionally, the circuit card 122 may include locating surfaces 196, such as along the first and second ends 180, 182. The locating surfaces may be used to position the circuit card 122 in the card guide module 130, such as for aligning the circuit card 122 with the card edge connector 120. In the illustrated embodiment, the locating surfaces 196 are positioned between the shoulders 194 and the latching features 190, 192; however, the locating surfaces 196 may be located at other positions in alternative embodiments.

The card guide module 130 includes the base 200 and the support beams 202, 204 extending from the base 200. Optionally, the support beams 202, 204 may be similar to each other and like components may be identified with like reference numbers. In general, the description below relates to the first support beam 202; however, the description may likewise be applicable to the second support beam 204. The support beam 202 extends from a top of the base 200, generally opposite a bottom 206 of the base 200, which is configured to be mounted to the host circuit board 110. In an exemplary embodiment, the support beam 202 includes a mounting feature 208 for mounting the base 200 to the host circuit board 110. In the illustrated embodiment, the mounting feature 208 is an opening configured to receive mounting hardware, such as a fastener. Other types of mounting features may be provided in alternative embodiments, such as a threaded opening, a post, a barb, a solder feature, and the like.

The base 200 includes an inner end 210 configured to face the card edge connector 120 and an outer end 212 opposite the inner end 210. Optionally, the base 200 may include opposite sides 214, 216 (shown in FIG. 1). Optionally, the card guide module 130 has a support tab 218 extending from the base 200 at the outer end 212 and/or the support beam 202 for supporting the card guide module 130 on the host circuit board 110. The support tab 218 may include one of the mounting features 208, such as a post, an opening, and the like. The base 200 includes a top 219 and the support beams 202, 204 extend from the top 219.

The base 200 includes one or more locating cavities 220 having one or more locating surfaces 222 configured to locate the card guide module 130 relative to the card edge connector 120. In an exemplary embodiment, the locating cavity 220 is provided at the inner end 210 and at the bottom 206 of the base 200. The locating cavity 220 is open at the inner end 210 and at the bottom 206 to receive a portion of the card edge connector 120. The locating surfaces 222 are configured to engage the card edge connector 120 to register the location of the card guide module 130 relative to the card edge connector 120. For example, the locating surfaces 222 may guide side-to-side positioning, end-to-end positioning and/or vertical positioning of the card guide module 130 relative to the card edge connector 120.

The support beam 202 extends from the base 200 to a distal end 230. The support beam 202 is used to guide mating of the circuit card 122 to the card guide module 130. The support beam 202 supports the circuit card 122 to alleviate stresses and strains on the card edge connector 120, such as from movement of the circuit card 122 by transferring the stresses and strains to the base 200 and the host circuit board 110. The support beam 202 includes a rail 232 defining a channel 234 (also shown in FIG. 5). The rail 232 includes support surfaces 236 (only one shown in FIG. 3) facing the channel 234. The circuit card 122 is configured to be captured in the channel 234 between the support surfaces 236. For example, when the circuit card 122 is in the channel 234, the rail 232 supports opposite sides of the circuit card 122 for positioning of the circuit card 122 in the card guide module 130.

In an exemplary embodiment, the support beam 202 includes locating arms 238 at the support surfaces 236, such as first and second locating arms at the first and second support surfaces, respectively, on opposite sides of the channel 234. Optionally, the locating arm 238 is cantilevered, such as at a top or fixed end 240 of the locating arm 238. The locating arm 238 has a free end 242 opposite the fixed end 240. The locating arm 238 is pivotably coupled to the support beam 202 at the fixed end 240. When the circuit card 122 is received in the channel 234, the locating arm 238 may be displaced, such as forced outward, by the circuit card 122. The locating arm 238 is elastically deformed when displaced creating an internal biasing force forcing the locating arm 238 inward against the circuit card 122. The locating arms 238 on opposite sides of the channel 234 pressed inward against the circuit card 122 in opposing directions to position the circuit card 122 within the channel 234. For example, the circuit card 122 may be centered in the channel 234 between the locating arms 238. Optionally, the locating arm 238 includes a protrusion 244 extending into the channel 234. The protrusion 244 may include a ramp 246 at the top end to guide mating with the circuit card 122. The circuit card 122 forces the protrusion 244, and thus the locating arm 238, outward when the circuit card 122 is loaded into the card guide module 130.

In an exemplary embodiment, the card guide module 130 includes a locking arm 250 pivotably coupled to the support beam 202. The locking arm 250 is movable between a latched position (FIG. 4) and an unlatched position. In an exemplary embodiment, the locking arm 250 is pivotable about an axle 252. The axle 252 may be integral with the locking arm 250. Alternatively, the axle 252 may be a separate component, such as a pin passing through the support beam 202 and the locking arm 250. Optionally, when the axle 252 is integral with the locking arm 250, rotation of the locking arm 250 to the unlatched position causes elastic deformation of the material of the axle 252 and/or the locking arm 250 created an internal biasing force to automatically return the locking arm 250 to the latched position. Alternatively, a separate biasing mechanism, such as a return spring, may engage the locking arm 250 to return the locking arm 250 to the latched position.

The locking arm 250 includes an actuator 254 configured to be operated by the user to move the locking arm 250 from the latched position to the unlatched position. For example, the actuator 254 may be exposed at the exterior of the support beam 202. The user may press inward and/or upward on the actuator 254 to move the locking arm 250 to the unlatched position.

The locking arm 250 includes a latch 256 at a distal end 258 thereof. The latch 256 is configured to be latch be secured to the circuit card 122 in the latched position to secure the circuit card 122 in the card guide module 130. Optionally, the latch 256 is located vertically below the actuator 254 with the axle 252 positioned in a vertical height between the latch 256 and the actuator 254. Actuation of the actuator 254 causes the latch 256 to rotate or pivot away from the circuit card 122.

In the illustrated embodiment, the latch 256 is a bump or protrusion along an interior surface of the locking arm 250. The latch 256 is configured to be received in the corresponding latching feature 190, 192 of the circuit card 122 to secure the circuit card 122 in the channel 234. In an exemplary embodiment, the latch 256 is used to position the circuit card 122 relative to the card edge connector 120. For example, the latch 256 holds a vertical position of the circuit card 122 relative to the card edge connector 120 to align the contact pads 174 with the mating ends of the contacts 124. Optionally, the circuit card 122 is loaded into the card guide module 130 until the latches 256 are received in the latching features 190, 192. The latches 256 may stop or block further loading of the circuit card 122 into the card guide module 130.

In an exemplary embodiment, the locking arm 250 includes an ejector 260 configured to engage the circuit card 122 and move the circuit card 122 in an un-mating direction 262 when the locking arm 250 is moved to the unlatched position. In the illustrated embodiment, the ejector 260 is defined by a top surface 264 of the locking arm 250. The ejector 260 is located below the shoulder 194 of the circuit card 122. Actuation of the actuator 254 causes the ejector 260 to rotate or pivot upward into the shoulder 194 of the circuit card 122. When the latch 256 is released from the latching features 190, 192, the ejector 260 forces the circuit card 122 to move in the unmated direction 262. Such movement causes the latching features 190, 192 to move upward relative to the locking arm 250. As such, when the locking arm 250 is released, the latch 256 does not return into the latching feature 190, 192. Thus, the circuit card 122 is no longer able to be locked into the card guide module 130. The user may remove the circuit card 122 by lifting upward on the circuit card 122 to remove the circuit card 122 from the card guide module 130. Optionally, the ejector 260 may define a locating surface for locating the circuit card 122 in the card guide module 130. For example, the ejector 260 may be used to vertically locate the circuit card 122 along the Z-axis. The ejector 260 may define a stop surface when loading the circuit card 122 into the card guide module 130. For example, the circuit card 122 may be restricted from further loading once the shoulder 194 engages the ejector 260.

In an exemplary embodiment, the locking arm 250 includes a locating surface 266 for locating the circuit card 122 relative to the card guide module 130. The locating surface 266 may be defined by an interior surface of the locking arm 250, such as the surface above the latch 256. The locating surface 266 may be used to locate the circuit card 122 end-to-end, such as along the X-axis. Optionally, the locking arm 250 may include a lead-in surface 268 above the locating surface 266. The lead-in surface 268 may guide the circuit card 122 to the locating surface 266. In the illustrated embodiment, the lead-in surface 268 extends between the ejector 260 and the locating surface 266.

Figure 5:
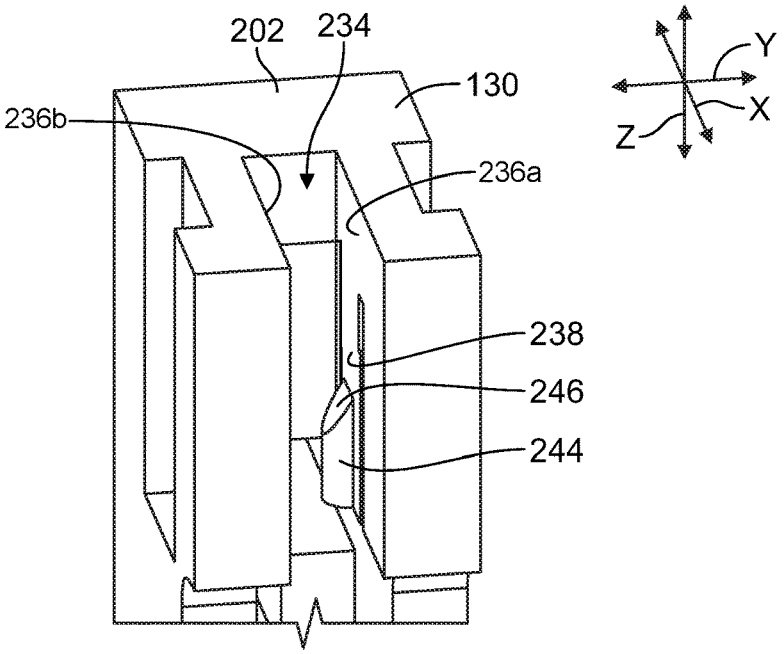
FIG. 5 is an enlarged view of a portion of the card guide module.

FIG. 5 is an enlarged view of a portion of the card guide module 130 showing the support beam 202. The channel 234 is provided in the rail 232 between the first and second support surfaces 236*a*, 236*b*. In the illustrated embodiment, the locating arms 238 are provided on both sides of the channel 234. The protrusions 244 extend into the channel 234. When the circuit card 122 is received in the channel 234, the circuit card 122 may ride along the ramps 246 forcing the protrusions 244, and thus the locating arms 238, outward. The locating arms 238 may be spring biased against the circuit card 122 to locate the circuit card 122 between the first and second support surfaces 236. The locating arms 238 are used to locate the circuit card 122 side-to-side, such as along the Y-axis.

Figure 6:
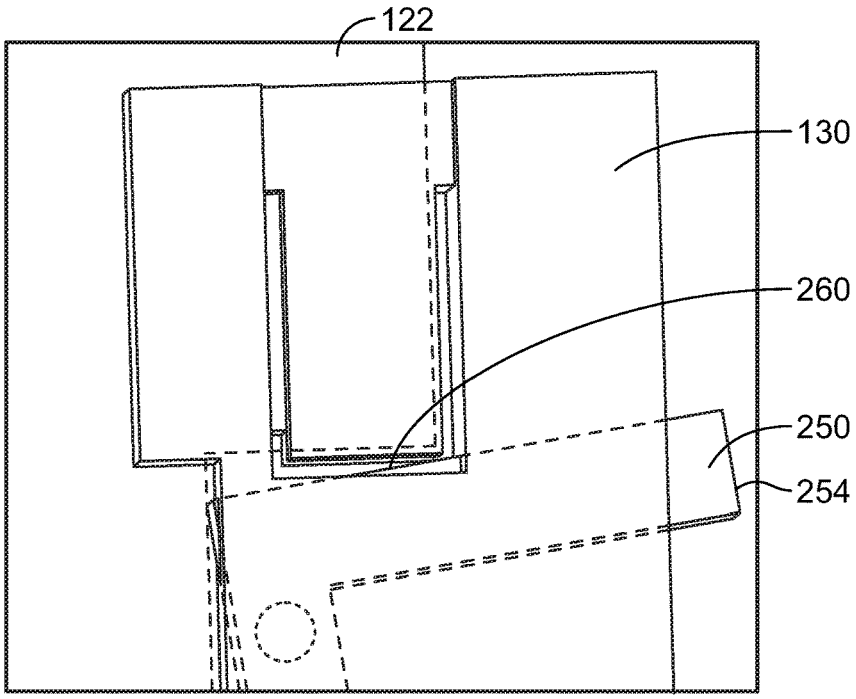
FIG. 6 is an enlarged view of a portion of the card guide module.

FIG. 6 is an enlarged view of a portion of the card guide module 130 showing the locking arm 250 in an unlatched position. The actuator 254 is actuated (for example, pressed inward and/or upward) to pivot the locking arm 250 to the unlatched position. The ejector 260 is lifted upward when the locking arm 250 is actuated, forcing the circuit card 122 to lift upward. As such, the locking arm 250 is used to at least partially eject the circuit card 122 from the card guide module 130. When the locking arm 250 is released, the locking arm 250 is forced to return to the latched position.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A card edge connector assembly comprising:

a card edge connector having a housing defining a card slot configured to receive a circuit card in a mating direction, the housing holding contacts in the card slot to electrically connect to the circuit card, the contacts being configured to be electrically connected to a host circuit board;

a card guide module coupled to the housing, the card guide module having a base including a mounting feature configured to be secured to the host circuit board separate and independent of the card edge connector, the card guide module having a support beam extending from the base having a support surface configured to support the circuit card, the card guide module having a locking arm pivotably coupled to the support beam and movable between a latched position and an unlatched position, the locking arm having a latch at a distal end thereof configured to be latchably secured to the circuit card in the latched position to secure the circuit card in the card slot, the locking arm having an ejector configured to engage the circuit card and move the circuit card in an unmating direction when the locking arm is moved to the unlatched position, wherein the card guide module holds the locking arm relative to the host circuit board independent of the card edge connector and the housing of the card edge connector.

2. The card edge connector assembly of claim 1, wherein the latch engages the circuit card to control a depth of mating the circuit card in the card edge connector and to fix the position of the circuit card relative to the card edge connector.

3. The card edge connector assembly of claim 1, wherein the ejector engages the circuit card and lifts the circuit card at least partially out of the card edge connector when the locking arm is moved to the unlatched position.

4. The card edge connector assembly of claim 1, wherein the locking arm engages the circuit card to locate the circuit card relative to the card edge connector in at least two mutually perpendicular directions.

5. The card edge connector assembly of claim 1, wherein the support beam includes a rail defining a channel configured to receive the circuit card, the support beam having a first locating arm facing the channel and a second locating arm facing the channel on an opposite side of the rail from the first locating arm, the first locating arm being spring biased against a first side of the circuit card, the second locating arm being spring biased against a second side of the circuit card to locate the circuit card between the first and second locating arms.

6. The card edge connector assembly of claim 5, wherein the first and second locating arms include protrusions extending into the channel configured to engage the circuit card.

7. The card edge connector assembly of claim 1, wherein the support beam is a first support beam, the card guide module including a second support beam extending from the base, the first support beam being positioned at a first end of the card edge connector, the second support beam being positioned at a second end of the card edge connector, the second support beam having a second locking arm.

8. The card edge connector assembly of claim 1, wherein the support surface is a first support surface, the support beam having a second support surface, the first and second support surfaces engaging the circuit card to hold an X-position of the circuit card relative to the card guide module, the card guide module having locating surfaces engaging the circuit card to hold a Y-position of the circuit card relative to the card guide module, the latch of the locking arm engaging the circuit card to hold a Z-position of the circuit card relative to the card guide module.

9. The card edge connector assembly of claim 1, wherein the first and second card guide modules register a position of the circuit card relative to the card edge connector and support the circuit card to hold the circuit card relative to the contacts.

10. The card edge connector assembly of claim 1, wherein the base of the first card guide module and the base of the second card guide module are secured to the host circuit board by mounting hardware independent of the card edge connector.

11. The card edge connector assembly of claim 1, wherein the first support beam extends vertically above the base of the first card guide module to receive the pluggable module in a mating direction perpendicular to the host circuit board.

12. The card edge connector assembly of claim 1, wherein the first support beam extends from the base of the first card guide module generally parallel to the host circuit board.

13. A card edge connector assembly comprising:

a card edge connector having a housing defining a card slot configured to receive a circuit card in a mating direction, the housing holding contacts in the card slot to electrically connect to the circuit card, the contacts being configured to be electrically connected to a host circuit board, the housing having a first end, a second end, a first side and a second side, the contacts being arranged in an array along the first and second sides;

a card guide module coupled to the housing, the card guide module having a base including a mounting feature configured to be secured to the host circuit board separate and independent of the card edge connector, the card guide module having a support beam extending from the base having a rail including a first support surface and a second support surface on opposite sides of a channel configured to receive the circuit card, the support beam having a first locating arm at the first support surface being spring biased against a first side of the circuit card and the support beam having a second locating arm at the second support surface being spring biased against a second side of the circuit card to locate the circuit card between the first and second locating arms, wherein the card guide module holds the locking arm relative to the host circuit board independent of the card edge connector and the housing of the card edge connector.

14. The card edge connector assembly of claim 13, wherein the first and second locating arms include protrusions extending into the channel configured to engage the circuit card.

15. The card edge connector assembly of claim 13, wherein the housing has a first mounting lug having a first datum surface at the first end of the housing and a second mounting lug having a second datum surface at the second end of the housing, the base including a first locating cavity having a first locating surface and a second locating cavity having a second locating surface, the first locating cavity receiving the first mounting lug and the first locating surface engaging the first datum surface to register the card guide module relative to the housing, the second locating cavity receiving the second mounting lug and the second locating surface engaging the second datum surface to register the card guide module relative to the housing.

16. The card edge connector assembly of claim 13, wherein the card guide module includes a first locking arm pivotably coupled to the first support beam and movable between a latched position and an unlatched position, the first locking arm having a first latch at a distal end thereof configured to be latchably secured to the circuit card in the latched position to secure the circuit card in the card slot, the first locking arm having a first ejector configured to engage the circuit card and move the circuit card in an unmating direction when the first locking arm is moved to the unlatched position.

17. A card edge connector assembly comprising:

a circuit card having a card edge extending between a first end and a second end, the card edge having contact pads at a first side and a second side of the circuit card;

a card edge connector having a housing defining a card slot configured to receive the card edge of the circuit card in a mating direction, the housing holding contacts in the card slot to electrically connect to the contact pads of the circuit card, the contacts being configured to be electrically connected to a host circuit board;

a card guide module coupled to the housing, the card guide module having a base including a mounting feature configured to be secured to the host circuit board independent of the card edge connector, the card guide module having a support beam extending from the base having a rail including a channel between first and second support surfaces configured to receive the circuit card, the first and second support surfaces engaging the circuit card to hold an X-position of the circuit card relative to the card guide module, the card guide module having locating surfaces engaging the circuit card to hold a Y-position of the circuit card relative to the card guide module, the card guide module having a locking arm engaging the circuit card to hold a Z-position of the circuit card relative to the card guide module, the locking arm having a latch at a distal end thereof configured to be latchably secured to the circuit card to secure the circuit card in the card slot;

wherein the card guide module supports the circuit card independent of the card edge connector.

18. The card edge connector assembly of claim 17, wherein the support beam includes a first locating arm at the first support surface being spring biased against a first side of the circuit card and the support beam having a second locating arm at the second support surface being spring biased against a second side of the circuit card to locate the circuit card between the first and second locating arms.

19. The card edge connector assembly of claim 17, wherein the first card guide module and the second card guide module are positioned to have a tighter tolerance than the card edge connector for locating the pluggable module.

20. The card edge connector assembly of claim 17, wherein the first and second card guide modules register a position of the circuit card relative to the card edge connector and support the circuit card to hold the circuit card relative to the contacts.

* * * * *